US010109135B2

(12) United States Patent
Sperl et al.

(10) Patent No.: US 10,109,135 B2
(45) Date of Patent: Oct. 23, 2018

(54) SUPPLY MODULE AND METHOD FOR SUPPLYING VALUE DOCUMENTS TO A VALUE DOCUMENT PREPARATION DEVICE

(71) Applicant: GIESECKE & DEVRIENT GMBH, München (DE)

(72) Inventors: Markus Sperl, Garching (DE); Peter Dopfer, Geltendorf (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/304,003

(22) PCT Filed: Apr. 23, 2015

(86) PCT No.: PCT/EP2015/000842
§ 371 (c)(1),
(2) Date: Oct. 13, 2016

(87) PCT Pub. No.: WO2015/161925
PCT Pub. Date: Oct. 29, 2015

(65) Prior Publication Data

US 2017/0032606 A1 Feb. 2, 2017

(30) Foreign Application Priority Data

Apr. 25, 2014 (DE) ..... 10 2014 006 053

(51) Int. Cl.
*G07D 13/00* (2006.01)
*G07D 11/00* (2006.01)
*B65H 1/26* (2006.01)

(52) U.S. Cl.
CPC ..... *G07D 11/0018* (2013.01); *B65H 1/266* (2013.01); *G07D 11/0003* (2013.01);
(Continued)

(58) Field of Classification Search
CPC ..... G07D 13/00; G07D 11/0018; G07D 11/0003; G07F 19/202; B65H 83/00;
(Continued)

(56) References Cited

U.S. PATENT DOCUMENTS 3,799,538 A * 3/1974 Suzuki ..... G03B 27/586 271/117
4,531,344 A 7/1985 Sato et al.
(Continued)

FOREIGN PATENT DOCUMENTS

DE 3246865 A1 7/1983
DE 2760269 C2 3/1987
(Continued)

OTHER PUBLICATIONS

International Preliminary Report on Patentability for corresponding International PCT Application PCT/EP2015/00842, dated Oct. 25, 2016.
(Continued)

*Primary Examiner* — Thomas A Morrison
(74) *Attorney, Agent, or Firm* — Workman Nydegger

(57) ABSTRACT

A feed module for feeding value documents, in particular bank notes, to a value-document processing apparatus, has a receiving device in which one or more value documents to be processed can be inserted. The receiving device includes a first aligning element which the value documents lying in the receiving device are aligned to with a first edge of the value documents when the receiving device is in a first state, and a second aligning element which the value documents lying in the receiving device are aligned to with a second edge of the value documents when the receiving device is in a second state. A positioning device through which the receiving device is brought from the first state to the second state.

19 Claims, 5 Drawing Sheets

(52) U.S. Cl.
CPC ..... *B65H 2301/4222* (2013.01); *B65H 2404/692* (2013.01); *B65H 2405/113* (2013.01); *B65H 2405/114* (2013.01); *B65H 2701/1912* (2013.01); *G07D 2211/00* (2013.01)

(58) Field of Classification Search
CPC ..... B65H 85/00; B65H 1/06; B65H 1/266; B65H 2301/4222
See application file for complete search history.

(56) References Cited

U.S. PATENT DOCUMENTS

| | | | | |
|---|---|---|---|---|
| 5,136,956 | A | 8/1992 | Kitamura | |
| 5,292,114 | A * | 3/1994 | McConnell | B65H 1/24 271/146 |
| 5,713,713 | A * | 2/1998 | Syde | B07C 1/025 414/403 |
| 6,446,955 | B1 * | 9/2002 | Janatka | B65H 3/10 271/104 |
| 7,152,744 | B2 | 12/2006 | Kunz et al. | |
| 2004/0225407 | A1 | 11/2004 | Kunz et al. | |
| 2014/0131163 | A1 * | 5/2014 | Yun | G07F 19/202 194/206 |

FOREIGN PATENT DOCUMENTS

| | | | |
|---|---|---|---|
| DE | 10030221 | A1 | 1/2002 |
| GB | 2238299 | A | 5/1991 |
| JP | H0540870 | A | 2/1993 |
| WO | 2014012664 | A1 | 1/2014 |

OTHER PUBLICATIONS

International Search Report for corresponding International PCT Application PCT/EP2015/00842, dated Aug. 24, 2015.

* cited by examiner

SUPPLY MODULE AND METHOD FOR SUPPLYING VALUE DOCUMENTS TO A VALUE DOCUMENT PREPARATION DEVICE

BACKGROUND

This invention concerns a feed module and a method for feeding value documents to a value-document processing apparatus, an input module, and a value-document processing apparatus for processing value documents according to the independent claims.

In value-document processing apparatuses, value documents, such as bank notes, checks or vouchers, are checked for different properties, such as denomination, authenticity and condition, and treated differently depending on the result of the check. Thus, e.g. bank notes classified as authentic upon the check are returned to circulation provided they simultaneously meet certain fitness criteria. In contrast, bank notes classified as false or suspect are taken out of circulation, and soiled, worn or defective bank notes are fed to a shredder for destruction. Further, in value-document processing apparatuses the respectively inputted value documents can be counted and/or their total value established.

From DE 27 60 269 C2 an apparatus for automatically sorting value documents is known which has an input pocket for receiving value documents, a singling device, a transport system, a checking device arranged along the transport system, and at least one deposit device. The value documents are sorted according to the results of the checking device, with indeterminable value documents, which are also called reject value documents, being placed in an intermediate store. A log about the reject value documents is created from the check results of the reject value documents. The log is used at a manual reworking station to manually evaluate and check the reject value documents taken from the intermediate store. The result of the manual check can be used to complete the sorting results.

To decrease manual reworking, the number of reject value documents to be manually reworked can be reduced by repeating the machine check of the reject value documents. The decrease in the number of reject value documents results from the fact that any disturbances that are present or faulty operating conditions that were present at the time of a first check of the value documents, e.g. skewed running or double picking of the value documents, normally no longer occur at the time of a second check of the reject value documents. The correct check and classification of the reject value documents is therefore in many cases in fact possible upon the second check, which is also called rerun. For example, the reject value documents are manually re-inserted into the value-document processing apparatus to re-check them. In DE 10 030 221 A1 a returning of the reject value documents to the input pocket of the apparatus is proposed, from which the reject value documents are singled in order to be fed to for a recheck in the apparatus.

SUMMARY

However, the previous re-inserting of the reject value documents into the input pocket requires that the operator at the apparatus starts the rerun at the right point in time. For this, the operator must wait until the apparatus has singled all value documents located in the input pocket. Only then can the reject value documents be re-introduced into the input pocket and their rerun be started manually.

It is the object of the invention to enable a feeding of value documents, in particular reject value documents, to the value-document processing apparatus in manner as user-friendly and reliable as possible.

The feed module according to the invention for feeding value documents, in particular bank notes, to a value-document processing apparatus has: a receiving device in which one or more value documents to be processed can be inserted, with at least a first aligning element which the value documents lying in the receiving device are aligned to with a first edge of the value documents when the receiving device is in a first state, and at least a second aligning element which the value documents lying in the receiving device are aligned to with a second edge of the value documents when the receiving device is in a second state, and a positioning device through which the receiving device can be brought from the first state to the second state.

The input module according to the invention for feeding value documents, in particular bank notes, to at least one value document processing device has: a removal device for removing value documents from a container in which the value documents are supplied, and for feeding the value documents removed from the container to the value-document processing apparatus, as well as a feed module according to the invention.

The value-document processing apparatus according to the invention for processing, in particular checking and/or counting and/or sorting and/or destroying, value documents has a feed module according to the invention.

The method according to the invention for feeding value documents, in particular bank notes, to a value document processing device has the following steps: Inserting one or more value documents to be processed into a receiving device, aligning the value documents lying in the receiving device, which is in a first state, with a first edge of the value documents to at least a first aligning element, shifting the receiving device to a second state, and aligning the value documents lying in the receiving device, which is in the second state, with a second edge of the value documents to at least a second aligning element.

After the aligning of the value documents to the second aligning element and/or at the same time as said aligning, the receiving device of the feed module is moved into an input pocket of the value-document processing apparatus to re-feed the value documents to the value documents processing apparatus. The inserting of the value documents into the receiving device of the feed module can be carried out manually, e.g. by hand by an operator, or also automatically, e.g. by a gripper.

For the purposes of the invention, the term "state" refers preferably to the orientation or alignment of the receiving device in space. The receiving device thus has in the first state a first spatial orientation or first spatial alignment that is different from a second spatial orientation or second spatial alignment in the second state. A different orientation or alignment can be achieved, for example, through a simple rotation in a plane around an axis of rotation. However, it is principally also possible to shift the receiving device through a more complex rotation around two or three spatial axes of Euclidean space from the first state to the second state and vice versa.

Independent thereof, the position of the receiving device can be substantially identical in the first and second state, i.e. the receiving device remains essentially at the same location in spite of the change of state. Alternatively, it can also be preferred that locations of the receiving device are different in the first and second state, i.e. the receiving device is at different locations in the first and second state.

The invention is based on the approach of providing a receiving device for receiving value documents to be processed, in particular reject value documents, with a first and second aligning element for aligning the received value documents to. The aligning elements can, for example, be in form of one or more lateral stops or a lateral wall of the receiving device. The receiving device is initially in a first state in which the value documents which are lying at a bottom region of the receiving device are aligned along a first edge of the value documents to a first aligning element. Preferably, the receiving device, in particular the bottom region of the receiving device, is inclined relative to the horizontal so that the value documents move in the direction of the first aligning element on account of the gravitation and are there finally aligned on their own. After the value documents have been inserted into the receiving device and have been aligned to the first the aligning element, the receiving device is brought to the second state by means of a positioning device, where the value documents which are lying in the receiving device, preferably inclined to the horizontal, move in the direction of the second aligning element on account of the gravitation and are there aligned with their second edge on their own.

Preferably, the first or second edges of the value document, which are aligned to the first and second aligning element, are adjacent edges, wherein the first edge of the value document is, for example, to the narrow side of the value documents (transverse edge) and the second edge to the longer side of the value documents (longitudinal edge). Here, the value documents inserted in the receiving device will thus at first be aligned with their transverse edge to the first alignment element before the receiving device is shifted to the second state in which the value documents are then aligned with their longitudinal edge to the second alignment element. However, the first edge can also be the longitudinal edge and the second edge the transverse edge.

Thus, the value documents inserted in the receiving device by the operator, in particular reject value documents, are aligned along their transverse as well as longitudinal edges in an easy and reliable manner, without requiring special preparatory acts by the operator, for example, a manual alignment through shaking, tapping or bending the value document stack.

The value documents aligned according to the invention can then be fed to the value-document processing apparatus, for example by moving the receiving device together with the value documents contained therein into the input pocket of the value-document processing apparatus where these are ultimately removed individually from the value document stack and fed to further processing. By the inventive alignment of the inserted value documents with their longitudinal and transverse edges, any problems with regard to the singling of the value documents can be prevented or at least reduced considerably. Thus the aligning of the edges on both sides in particular avoids the edges of some of the value documents of the inputted stack from being too remote from the singling device and furthermore avoids that transport problems such as double picking and high, low or skewed running might occur.

Altogether, the invention thus allows a user-friendly as well as reliable feeding of value documents, in particular reject value documents, to a value-document processing apparatus.

In contrast to the previous re-inserting of the reject value documents into the input pocket, the operator can already insert the reject value documents into the receiving device of the feed module before the apparatus has processed all value documents of the respective deposit located in the input pocket. The operator can then inform the apparatus (e.g. by pressing a button) that the reject value documents of the deposit just being processed are already lying in the receiving device.

If the operator of the apparatus has previously informed that the reject value documents of the deposit just being processed are already lying in the receiving device, the apparatus can independently initiate the moving of the feed module into the input pocket (and in this manner independently begin the post-processing of these reject value documents (rerun)) as soon as it has processed all value documents of this deposit located in the input pocket. Thus the inventive feed module makes it possible to begin the rerun quicker. The operator also no longer needs to wait until that point in time that the apparatus has singled all value documents located in the input pocket to then start the rerun. The operator can thus process the reject value documents more flexibly in terms of time.

In a preferred embodiment of the invention, the receiving device, in particular the bottom region of the receiving device, is inclined relative to the horizontal by an angle of inclination when the receiving device is in the first state and/or second state. The angle of inclination is selected here so that the value documents lying in the bottom region of the receiving device slide or glide on their own on account of their gravity in the direction of the lower lying side of the receiving device and are thus aligned to the first or second alignment element. The angle of inclination of the receiving device, in particular of the bottom region of the receiving device, is preferably at least 10°, in particular at least 20°, and/or is essentially identical in the first and second state of the receiving device. By using one or more of the above-mentioned measures, a reliable aligning of the value documents inserted in the receiving device as well as a user-friendly handling is achieved in a simple way.

The bottom of the receiving device can have a low-friction surface, wherein the coefficient of friction between the surface and the value documents is preferably lower than the coefficient of friction between the value documents themselves.

In another preferred embodiment of the invention it can be provided that the horizontally inclined receiving device has a first portion and a second, in relation to the first portion lower lying portion, and that the first aligning element is in the region of the lower lying portion of the receiving device in the first state, and that the second aligning element is in the region of the lower lying portion of the receiving device in the second state. By this means it is obtained that the first and second aligning element in the first state or the second state of the horizontally inclined receiving device are always at the respectively lower lying end of the receiving device inclined relative to the horizontal so that in the first state as well as in the second state of the receiving device an aligning of the value documents on its own along both edges, i.e. along the transverse and longitudinal edge, is obtained with high reliability.

In another preferred embodiment of the invention, the positioning device is so configured to bring the receiving device which is in the first state to the second state through rotating the receiving device by an angle of rotation. Here, the rotation axis preferably extends perpendicular to the plane of the bottom region of the receiving device, which is in particular inclined to the horizontal. Here, the angle of rotation is preferably between about 80° and 100°, in particular 90°. Thus the receiving device can in a simple manner be brought to the different states which are intended for a reliable aligning of both value document edges.

Preferably the positioning device is furthermore configured to move the receiving device through a translation, in particular relative to the value-document processing device. In particular, the positioning device can be so configured that a rotation of the receiving device around a certain angle of rotation and a translation of the receiving device along a certain path are effected at the same time. The aligning process and the feeding process are thus coupled with each other. In this manner it is possible to carry out an aligning of the value documents located in the receiving device along two value document edges together with a feeding of the value documents to the value-document processing apparatus, which accelerates the aligning and feeding process altogether, without adverse effect on the reliability of the aligning of the value documents. Further, through the mechanical coupling of the rotational motion to the translation motion, it can be obtained that the same drive (e.g. motor) effects the rotation as well as the translation of the receiving device.

In the above-described embodiment, the positioning device is preferably so configured that value documents located in the receiving device are fed to the value-document processing apparatus while the receiving device is being brought from first state to the second state.

However, it is alternatively or additionally also possible to configure the receiving device such that the value documents located in the receiving device are fed to the value-document processing apparatus after the receiving device has been brought from first state to the second state. By decoupling the aligning process from the feeding process, a reliable aligning and feeding of the value documents can be realized with especially simple mechanical components.

BRIEF DESCRIPTION OF THE DRAWINGS

Further features, advantages and application possibilities of the present invention will result from the following description in connection with the figures. There are shown.

DETAILED DESCRIPTION OF VARIOUS EMBODIMENTS

Figure 1:
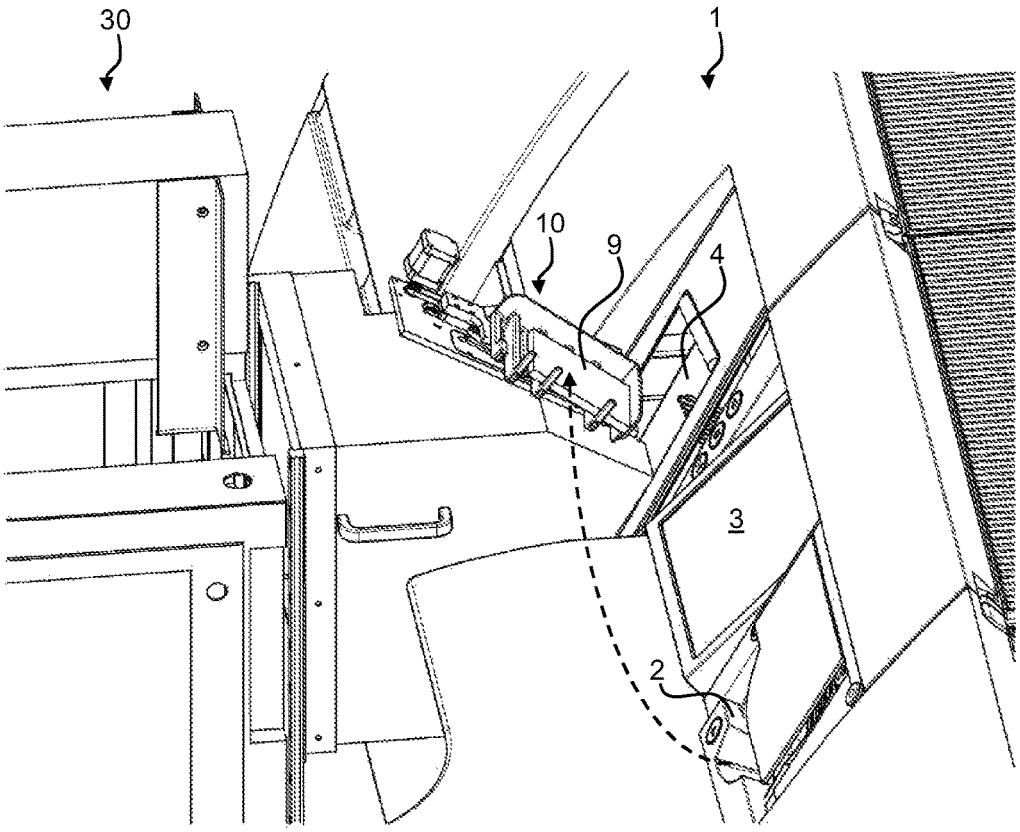
FIG. 1 a perspective view of a detail of a bank note processing apparatus with a feed module.

FIG. 1 shows a perspective view of a detail of a bank note processing apparatus 1 together with a feed module 10 and an input module 30.

In the represented detail of the bank note processing apparatus 1, a so-called reject output pocket 2 can be seen, to which bank notes are outputted which are rejected by the check in the bank note processing apparatus 1 (e.g. not recognized bank notes, bank notes with misfeeds etc.) and are there not outputted to one of the intended other output pockets (not shown).

Bank notes outputted to the reject output pocket 2 can in principle be reworked manually by an operator, for example to determine their denomination, authenticity or condition. To reduce the effort of manual reworking, a rechecking and processing of the reject bank notes is preferably carried out in the bank note processing apparatus 1 by the bank notes outputted to the reject output pocket 2 being removed from the output pocket 2 by the operator and inserted into the feed module 10, which is indicated by a dotted arrow in the chosen representation.

The feed module 10 is preferably so configured that the inserted bank notes 9 are aligned along their transverse edges as well as their longitudinal edges and are inserted into an input pocket 4 of the bank note processing apparatus 1, where they are then individually removed from stack and supplied again for checking and processing.

For example, the bank note processing apparatus 1 is so configured that it requests the operator, where applicable, to manually insert the bank notes outputted to the reject-output pocket 2 into the receiving device 11 of the feed module 10. Such an command output can, for example, be the displaying of a corresponding instruction in display 3. A suitable point in time for outputting a corresponding request can be present, for example, when the bank note processing apparatus 1 has completed the processing of a so-called deposit with bank notes to be deposited and now the reject bank notes of this deposit are to be post-processed. However, this request to the operator is pointed out only if the device has previously not received any information from the operator whether the reject bank notes of the respective deposit have already been inserted into the receiving device 11 of the feed module 10. If the operator has already informed the device that the reject bank notes have been inserted into the receiving device 11, the above-mentioned request can be omitted.

FIG. 1 further shows an input module 30 which is so configured that bank notes supplied in a container (not shown) can be removed from the container by means of a removal device (e.g. gripper) and likewise be inputted into the input pocket 4. In the shown example, the bank notes are taken from a container inside the input module 30 by means of the removal device and are inserted into the lower part of the input pocket which is located below the feed module. Preferably the input module 30 is of mobile configuration so as to be displaceable toward as well as away from the bank note processing apparatus 1.

The feed module 10 can be a permanent component of the bank note processing apparatus 1 but can also be a temporarily coupleable component. Alternatively or additionally it is also possible that the feed module 10 is a permanent component of the input module 30 but can also be a temporarily coupleable component.

Construction and the manner of functioning of the feed module 10 will be explained below more closely with reference to FIGS. 2 to 7.

Figure 2:
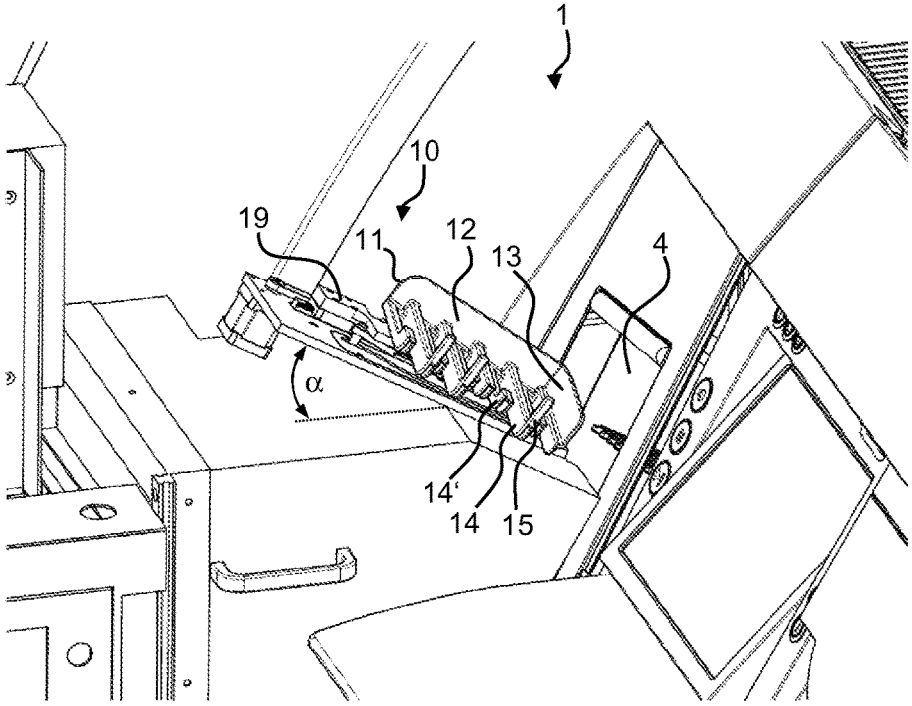
FIG. 2 a perspective view of a detail of a bank note processing apparatus with a feed module, in a first phase.

FIG. 2 shows a perspective view of a detail of a bank note processing apparatus 1 together with a feed module 10 in a first phase. A receiving device 11 intended for receiving bank notes has a longitudinal wall 12 as well as a lateral wall 13 extending transversely to the longitudinal wall 12. Starting out from the longitudinal wall 12, there extend shorter pins 14' and longer pins 14 through which a bottom-side supporting plane is formed for the bank notes to be received. At the distal end of the longer pins 14 these merge directly into an abutment region 15 which runs perpendicular to the pins 14.

The receiving device 11 is coupled with a positioning device 19 through which the receiving device 11 can be brought to different states, i.e. orientations and/or positions, i.e. locations. In the shown alignment of the receiving device 11 represented here by way of example, the receiving device is in a first state in which the longitudinal side of the receiving device 11, which is formed by the abutment region 15 and is thus partially open, is pointing in the direction of the operator.

The receiving device 11, in particular the bottom-side supporting plane defined by the pin 14 and 14' of the receiving device 11, is inclined to the horizontal by an angle of inclination $\alpha$, wherein the angle of inclination $\alpha$ amounts preferably to at least 10°, in particular to at least 20°.

Figure 3:
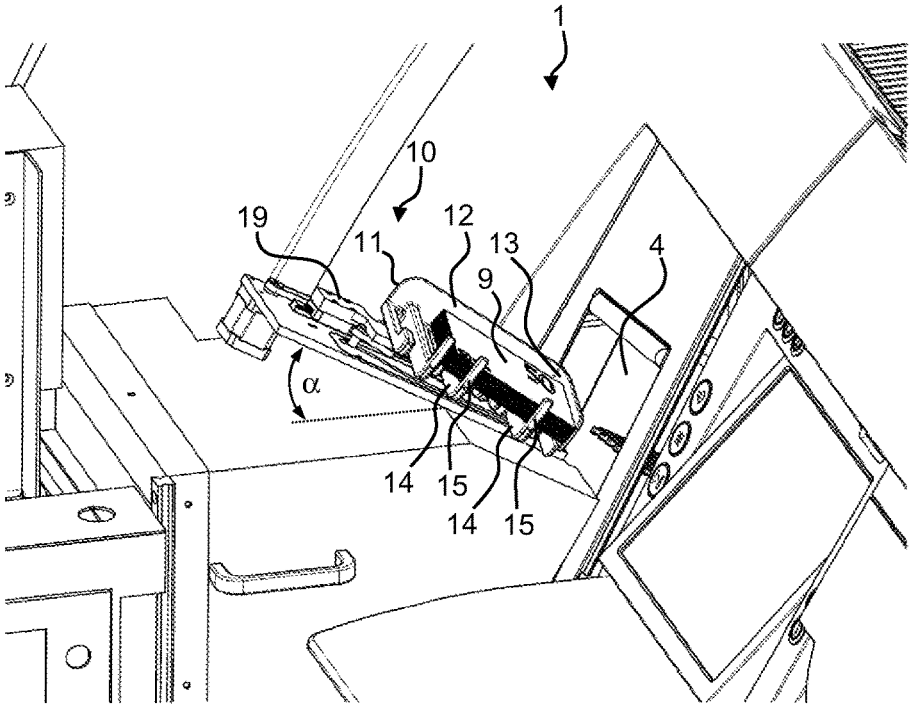
FIG. 3 a perspective view of the detail of the bank note processing apparatus shown in FIG. 2 with the feed module, in a second phase.

FIG. 3 shows a perspective view of the detail of the bank note processing apparatus 1 shown in FIG. 2 with the feed module 10 in a second phase, in which a stack of bank notes 9, in particular reject bank notes, has been inserted into the receiving device 11 by an operator. The underside of the stack of bank notes 9 is lying on the bottom region of the receiving device 11 formed by the long and short pins 14 and 14' and slides by gravity in the direction of the lateral wall 13 of the receiving device 11 due to the inclination of the receiving device 11 relative to the horizontal so that the transverse edges of the bank notes 9 are aligned to the lateral wall 13. Here, the longitudinal wall 12 and the abutment regions 15 opposing it prevent that the bank notes 9 of the stack slip out at the back or front of the receiving device 11.

Figure 4:
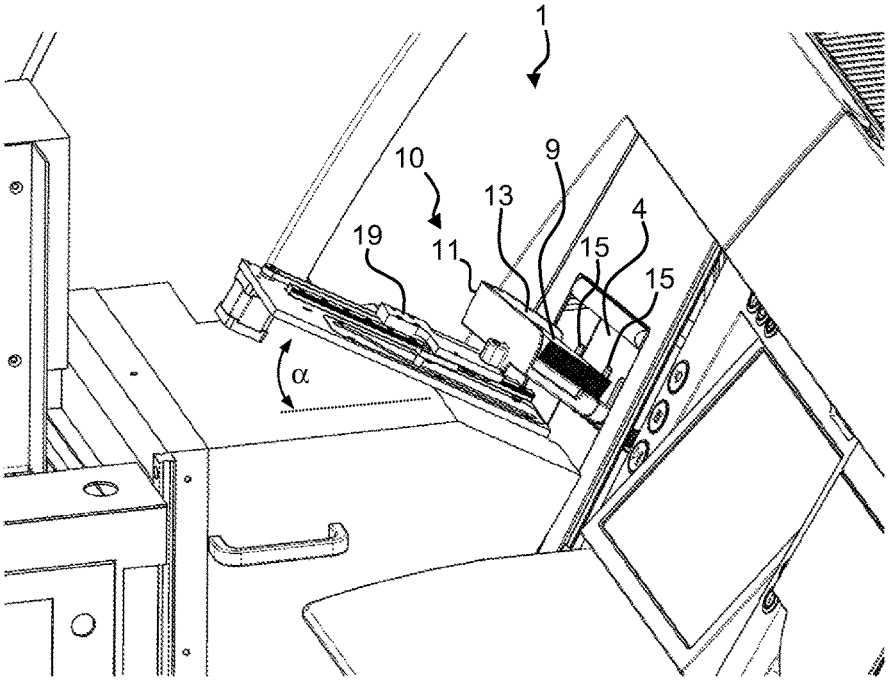
FIG. 4 a perspective view of the detail of the bank note processing apparatus shown in FIG. 3 with the feed module, in a third phase.

FIG. 4 shows a perspective view of the detail of the bank note processing apparatus 1 shown in FIG. 3 with the feed module 10 in a third phase, in which the receiving device 11 has been brought by the positioning device 19 in a second state, in which the receiving device 11 is rotated by about 90° in anticlockwise direction relative to the first state shown in FIG. 2. In the second state shown here, the partially open longitudinal side of the receiving device 11 formed by the abutment regions 15 is now pointing toward the input pocket 4 of the bank note processing apparatus 1.

In this second state the bottom surface of the receiving device 11 also retains its inclination relative to the horizontal so that the bank notes 9 located in the receiving device 11 are now moved by gravity toward the abutment regions 15 and are aligned to these.

For this, the rotation of the receiving device 11 is preferably carried out such that the aligning of the bank notes 9 with their transverse edges to the lateral wall 13 effected already in the second phase (see FIG. 3) is retained. In the third phase represented here, the bank notes 9 of the stack inserted in the receiving device 11 are now aligned along their transverse edges as well as along their longitudinal edges.

In the shown example the positioning device 19 is preferably so configured that the receiving device 11 is moved toward the input pocket 4 through a translation, i.e. a linear motion, in addition to the rotation.

Figure 5:
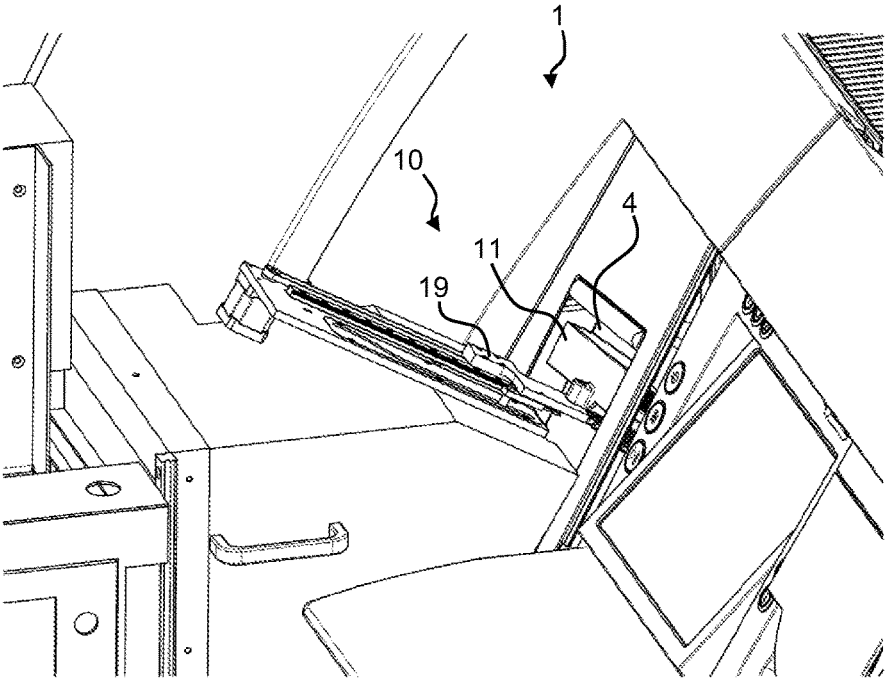
FIG. 5 a perspective view of the detail of the bank note processing apparatus shown in FIG. 4 with the feed module, in a fourth phase.

FIG. 5 shows a perspective view of the detail of the bank note processing apparatus 1 shown in FIG. 4 with the feed module 10 in a fourth phase, in which the receiving device 11 has been moved completely into the input pocket 4 of the bank note processing apparatus 1 by the positioning device 19. The bank notes located in the receiving device 11 and aligned along their transverse and longitudinal edges can then be removed in the input pocket 4 from the receiving device 11 and be fed to a singling device, which will be explained more closely hereinafter with reference to FIGS. 6 and 7.

Figure 6A:
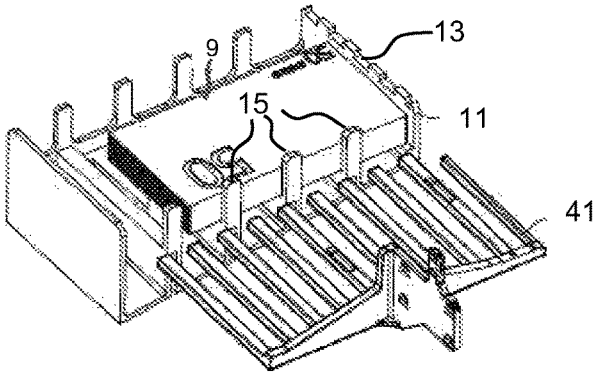
FIGS. 6*a* to 6*c* perspective views of a receiving device in different phases upon removal of bank notes by means of a rake.

FIG. 6*a*) to *c*) shows perspective views of a receiving device 11 in different phases upon the removal of bank notes 9 by means of a rake 41 located in the input pocket 4 of the bank note processing apparatus 1 (see FIGS. 1 to 4).

Figure 6B:
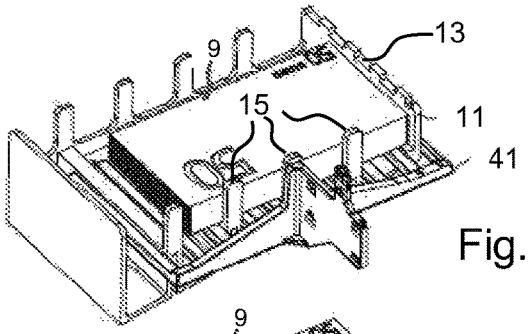
Figure 6C:
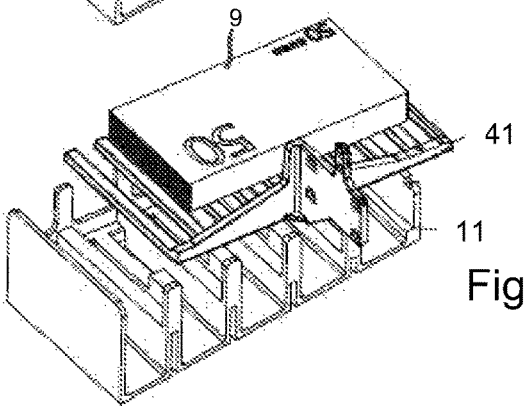

As indicated by FIG. 6*a*), the bank notes 9 of the bank note stack lying in the receiving device 11 with their transverse edges aligned to the lateral wall 13 and with their longitudinal edges to the abutment regions 15. The rake 41 moves toward the receiving device 11 and engages meshingly between the individual short and long pins 14' and 14 (see FIG. 2). This is illustrated in FIG. 6*b*).

Figure 7:
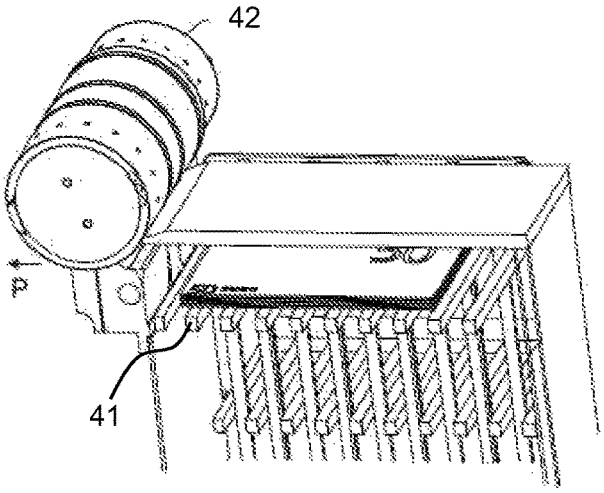
FIG. 7 a perspective view of a singler.

Through a vertically upward motion of the rake 41 (see FIG. 6*c*), the bank notes 9 are lifted from the receiving device 11 and can be fed, as is illustrated by way of example in FIG. 7, to a singling device 42 through which they are drawn individually from the stack in direction P.

Figure 8:
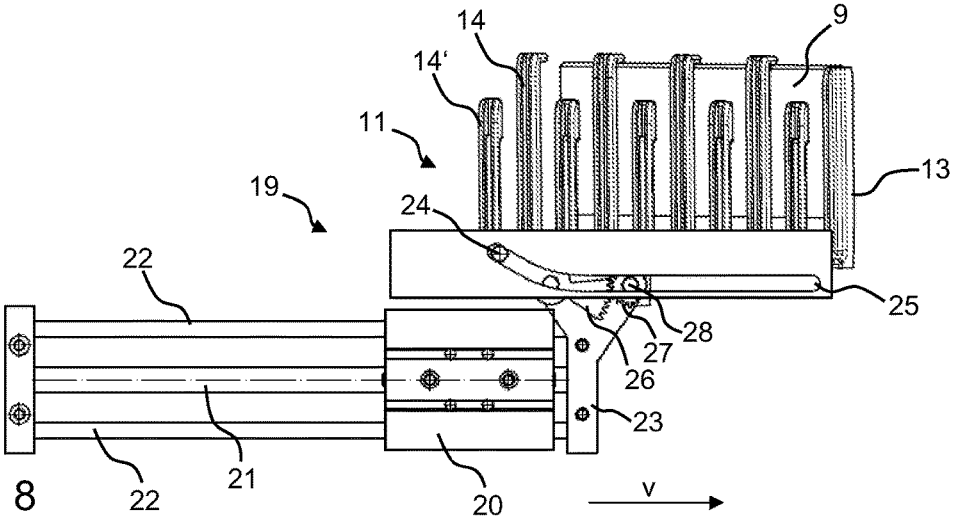
FIG. 8 a bottom view of a first example of a positioning device with a receiving device in a first state.

FIG. 8 shows a bottom view of a first example of a positioning device 19 with a receiving device 11 in a first state. A stack of bank notes 9 is lying at the bottom region of the receiving device 11 formed by shorter pins 14' and longer pins 14 and is aligned to the lateral wall 13 due to the inclination relative to the horizontal of the bottom surface of the receiving device 11.

The positioning device 19 has a pneumatic cylinder 20 which is mounted movably to a piston rod 21 and is guided by means of additional guide rods 22. The pneumatic cylinder 20 is preferably mounted stationarily in the region of the input pocket 4 of the bank note processing apparatus 1 or at the input module 30 (see FIG. 1) so that the receiving device 11 coupled with the piston rod 21 and the guide rods 22 by a connection piece 23 can be moved in the direction v toward the input pocket 4 through the pneumatic cylinder 20.

A pin 24 located on a lever 26 engages with a bent and likewise stationarily arranged sliding block guide 25 and follows the motion of the connection piece 23 driven through the pneumatic cylinder 20 along the initially curved course of the sliding block 25. The pin 24 is coupled with the receiving device 11 via the lever 26 equipped with a tooth segment such that the deflection of the pin 24 upon its movement along the curved section of sliding block 25 leads to a rotation of the receiving device 11. For this purpose, the tooth segment of lever 26 engages a second tooth segment 27 which is mounted to a rotation axis 28 located on the receiving device 11.

Figure 9:
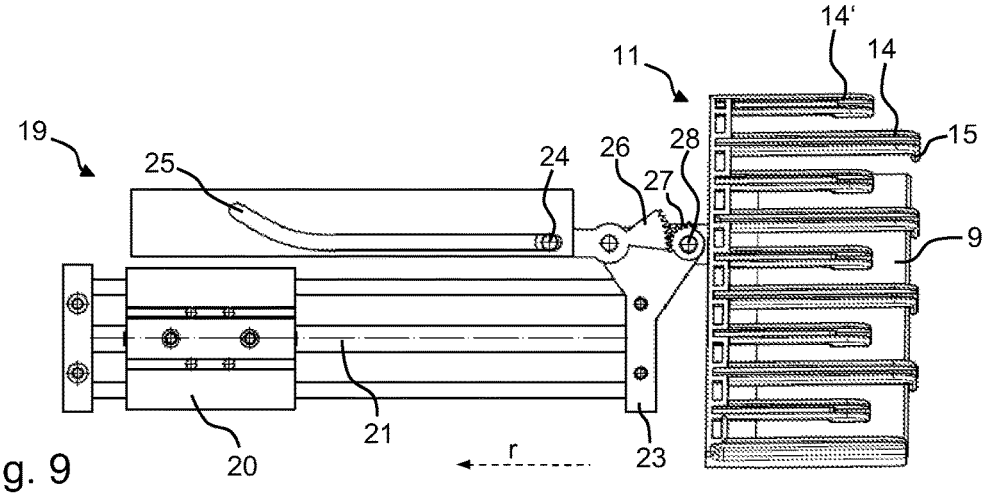
FIG. 9 a bottom view of the first example of a positioning device with the receiving device in a second state.

After the pin 24 has passed the initially curved course of the sliding block 25, it now follows a linear course of the sliding block 25 until the end of the sliding block 25 is finally reached. This situation is illustrated in FIG. 9. The positioning device 19 thus requires only a single drive, namely the pneumatic cylinder 20, to rotate the receiving device 11 from the first state shown in FIG. 8 to the second state shown in FIG. 9 and at the same time to move it translationally, i.e. in a straight line, toward the input pocket or away from it.

Due to the preferably unchanged inclination of the receiving device 11 relative to the horizontal, in particular of the bottom region of the receiving device 11, the bank notes 9 located in the receiving device 11 in the second state shown in FIG. 9 are aligned with their longitudinal edge to the abutment regions 15.

By a reversal of the drive through the pneumatic cylinder 20, the connection piece 23, together with the receiving device 11 rotatably mounted thereto, can again be moved in direction r away from the input pocket, wherein the pin 24 follows the stationarily arranged sliding block 25 in opposite direction so that the hereinabove described mechanism is executed in the reverse order until finally the first state of the receiving device 11 as shown in FIG. 8 is again reached.

By a choice of a suitable gear transmission ratio of the intended tooth segments on the lever 26 and the rotation axis 28, the swivel angle by which the receiving device 11 can be swiveled from the first state to the second state and vice versa can be influenced.

Figure 10:
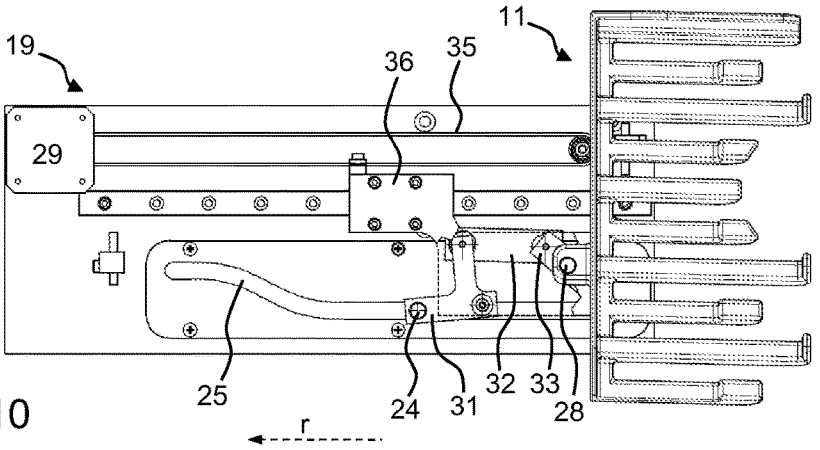
FIG. 10 a top view of a second example of a positioning device with a receiving device in a second state.

FIG. 10 shows a top view of a second example of a positioning device 19 with a receiving device 11 in a second state. Unlike the example shown in FIGS. 8 and 9, here a coupling between the rotatably mounted receiving device 11 and the pin 24 guided in the sliding block 25 is effected via a first lever 31, which is coupled via a connecting rod 32 with a second lever 33 attached to the rotation axis 28.

Unlike the example shown in FIGS. 8 and 9, a drive—instead of a pneumatic cylinder—is to be provided through an endless belt 35 which is driven by a motor 29. The linear motion of the endless belt 35 is transferred to the pin 24 by means of a coupling element 36 and the mechanics 31 to 33 coupled with it. Through a motion of the coupling element 36 in direction r, the pin 24 runs in the sliding block 25 and by the end of run follows the curved section of the sliding block 25, wherein the first lever 31 is rotated in clockwise direction and thereby effects through the connecting rod 32 a rotation of the second lever 33 and thus the receiving device 11 likewise in clockwise direction. Thus the example shown in FIG. 10 of a positioning device 19 also allows a simultaneous translation and rotation of the positioning device 11 through a single linear drive.

The invention claimed is:

1. A feed module for feeding value documents to a value-document processing apparatus, comprising:

a receiving device in which one or more of the value documents to be processed can be inserted, and which has a first aligning element, which respective first edges of the value documents lying in the receiving device are aligned to when the receiving device is in a first state, and which has a second aligning element, which respective second edges of the value documents lying in the receiving device are aligned to when the receiving device is in a second state, and a positioning device through which the receiving device can be brought from the first state to the second state;

wherein the second edges of the value documents lying in the receiving device are adjacent to the first edges of the value documents;

wherein the receiving device comprises a bottom surface on which the value documents rest, the bottom surface comprising first and second edges adjacent and extending perpendicular to each other, the first aligning element extending upwardly from the first edge relative to the bottom surface, and the second aligning element extending upwardly from the second edge relative to the bottom surface, and the bottom surface is inclined at a first angle of inclination relative to a horizontal plane such that the first aligning element is lower than the second aligning element when the receiving device is in the first state, and the bottom surface is inclined at a second angle of inclination relative to the horizontal plane such that the second aligning element is lower than the first aligning element when the receiving device is in the second state;

wherein the second edges of the value documents lying in the receiving device extend perpendicular to the first edges; and wherein the positioning device is so configured for moving the receiving device through a translation relative to the value-document processing apparatus, wherein the receiving device is moved into an input pocket of the value-document processing apparatus.

2. The feed module according to claim 1, wherein the receiving device in the first state and/or in the second state is inclined by an angle of inclination ($\alpha$) relative to the horizontal plane.

3. The feed module according to claim 2, wherein the angle of inclination ($\alpha$) is at least 10°.

4. The feed module according to claim 2, wherein the angle of inclination ($\alpha$) of the receiving device in the first state and the second state is substantially identical.

5. The feed module according to claim 4, wherein the angle of inclination ($\alpha$) is at least 20°.

6. The feed module according to claim 1, wherein the positioning device is configured for bringing the receiving device located in the first state to the second state through a rotation of the receiving device by an angle of rotation.

7. The feed module according to claim 1, wherein the positioning device is so configured that the rotation and the translation of the receiving device are effected simultaneously.

8. The feed module according to claim 6, wherein the angle of rotation is between about 80° and 100°.

9. The feed module according to claim 1, wherein the positioning device is so disposed and configured that the value documents located in the receiving device are fed to the value-document processing apparatus, and to the input pocket of the value-document processing apparatus after the receiving device has been brought from the first state to the second state.

10. An input module for feeding value documents to at least one value-document processing apparatus having a removal device for removing the value documents from a container in which the value documents are supplied, and for feeding the value documents removed from the container to the value-document processing apparatus, and to the input pocket of the value-document processing apparatus, and a feed module according to claim 1.

11. A value-document processing apparatus for processing value documents which has a feed module according to claim 1.

12. The feed module according to claim 1, wherein the positioning device is configured for bringing the receiving device located in the first state to the second state through a rotation of the receiving device by an angle of rotation, the positioning device is configured to be moved into the input pocket of the value-document processing apparatus by a direction of insertion, the plane of rotation being on a plane with the direction of insertion.

13. The feed module according to claim 1, wherein the first and second angles of inclination are the same.

14. The feed module according to claim 1, wherein the positioning device is so configured for moving the receiving device through a translation relative to the value-document processing apparatus, wherein the receiving device is moved into the input pocket of the value-document processing apparatus;

wherein the positioning device is configured for bringing the receiving device located in the first state to the second state through a rotation of the receiving device by an angle of rotation;

wherein the positioning device is configured so that the translation and the rotation of the receiving device are effected simultaneously.

15. The feed module according to claim 1, wherein the first state of the receiving device has a first spatial orientation different from a second spatial orientation in the second state, wherein the different orientation is achieved through a simple rotation in a plane around an axis of rotation.

16. The feed module according to claim 15, wherein the axis of rotation extends perpendicular to the plane of the bottom surface of the receiving device, which is inclined to the horizontal.

17. A method for feeding value documents to a value-document processing apparatus having the following steps:

a) inserting one or more value documents to be processed into a receiving device, b) aligning first edges of the value documents inserted in the receiving device to a first aligning element when the receiving device is in a first state, c) shifting the receiving device from the first state to a second state, d) aligning second edges of the value documents inserted in the receiving device to a second aligning element when the receiving device is in the second state, and e) moving the receiving device into an input pocket of the value-document processing apparatus;

wherein the second edges of the value documents lying in the receiving device are adjacent to the first edges of the value documents;

wherein the receiving device comprises a bottom surface on which the value documents rest, the bottom surface comprising first and second edges adjacent and extending perpendicular to each other, the first aligning element extending upwardly from the first edge relative to the bottom surface, and the second aligning element extending upwardly from the second edge relative to the bottom surface, and the bottom surface is inclined at a first angle of inclination relative to a horizontal plane such that the first aligning element is lower than the second aligning element when the receiving device is in the first state, and the bottom surface is inclined at a second angle of inclination relative to the horizontal plane such that the second aligning element is lower than the first aligning element when the receiving device is in the second state;

wherein the second edges of the value documents lying in the receiving device extend perpendicular to the first edges; and wherein the step of moving the receiving device into the input pocket of the value-document processing apparatus is configured for moving through a translation relative to the value-document processing apparatus.

18. The method according to claim 17, wherein the inserted value documents are reject value documents and said reject value documents are inserted into the receiving device of the feed module before the value-document processing apparatus has processed all value documents inserted in the input pocket of the value-document processing apparatus of a deposit to which said reject value documents belong and in the case when the value-document processing apparatus has been informed that the reject value documents of the deposit just being processed are already lying in the receiving device, the value-document processing apparatus will independently cause the receiving device to move into the input pocket as soon as it has processed all value documents of said deposit which are located in the input pocket.

19. A feed module for feeding value documents to a value-document processing apparatus, comprising:

a receiving device in which one or more of the value documents to be processed can be inserted, and which has a first aligning element, which respective first edges of the value documents lying in the receiving device are aligned to when the receiving device is in a first state, and which has a second aligning element, which respective second edges of the value documents lying in the receiving device are aligned to when the receiving device is in a second state, the second edges being different edges than the first edges, and a positioning device through which the receiving device can be brought from the first state to the second state;

in the first state the receiving device is inclined relative to a horizontal plane so that the value documents move toward the first aligning element on account of gravitation, and in the second state the receiving device is inclined relative to the horizontal plane so that the value documents move toward the second aligning element on account of the gravitation; and wherein the positioning device is so configured for moving the receiving device through a translation relative to the value-document processing apparatus, wherein the receiving device is moved into an input pocket of the value-document processing apparatus.

* * * * *